US007877919B2

(12) United States Patent
Richards

(10) Patent No.: US 7,877,919 B2
(45) Date of Patent: Feb. 1, 2011

(54) MUZZLELOADER FIREARM SYSTEM

(76) Inventor: Marlowe R. Richards, 225 W. 1100 South, Orem, UT (US) 84058

( * ) Notice: Subject to any disclaimer, the term of this patent is extended or adjusted under 35 U.S.C. 154(b) by 736 days.

(21) Appl. No.: 11/823,184

(22) Filed: Jun. 27, 2007

(65) Prior Publication Data

US 2011/0000118 A1 Jan. 6, 2011

Related U.S. Application Data

(60) Provisional application No. 60/817,574, filed on Jun. 28, 2006.

(51) Int. Cl.
*F41C 9/08* (2006.01)

(52) U.S. Cl. ..... 42/51

(58) Field of Classification Search ..... 42/51; 89/20.2

See application file for complete search history.

(56) References Cited

U.S. PATENT DOCUMENTS

| | | | | | |
|---|---|---|---|---|---|
| 26,256 | A | * | 11/1859 | Cochran | 89/17 |
| 33,530 | A | * | 10/1861 | Liesen | 89/20.2 |
| 470,284 | A | * | 3/1892 | Canet | 89/20.2 |
| 1,300,356 | A | * | 4/1919 | Dawson et al. | 89/20.2 |
| 1,388,607 | A | * | 8/1921 | Schneider | 89/20.2 |
| 1,695,728 | A | * | 12/1928 | Dawson et al. | 89/20.2 |
| 2,115,743 | A | * | 5/1938 | Niblett | 285/391 |
| 2,537,063 | A | * | 1/1951 | Kroeger et al. | 89/1.705 |
| 2,960,916 | A | * | 11/1960 | Rex | 89/20.2 |
| 4,222,191 | A | * | 9/1980 | Lee et al. | 42/77 |
| 4,328,633 | A | | 5/1982 | Pachmayr et al. | |
| 4,353,282 | A | | 10/1982 | Holt | |
| 4,411,088 | A | | 10/1983 | Wilson | |
| 4,437,249 | A | * | 3/1984 | Brown et al. | 42/51 |
| 4,854,065 | A | | 8/1989 | French et al. | |
| D305,030 | S | | 12/1989 | Fukushima | |
| D305,031 | S | | 12/1989 | Fukushima | |
| 4,936,035 | A | | 6/1990 | Reese et al. | |
| 4,989,357 | A | | 2/1991 | Norman et al. | |
| 5,307,583 | A | * | 5/1994 | Mahn et al. | 42/51 |
| 5,440,963 | A | * | 8/1995 | Szecsei | 89/1.41 |
| 5,615,507 | A | | 4/1997 | French | |
| 5,632,109 | A | * | 5/1997 | Caudle | 42/51 |
| 5,639,981 | A | | 6/1997 | French | |
| 5,680,722 | A | | 10/1997 | French et al. | |
| 5,737,863 | A | * | 4/1998 | Rainey, III | 42/51 |
| 5,782,030 | A | | 7/1998 | French | |
| 5,836,099 | A | | 11/1998 | Pace et al. | |
| D405,147 | S | | 2/1999 | Cash et al. | |
| 5,950,864 | A | | 9/1999 | Cash et al. | |
| 6,055,760 | A | | 5/2000 | Cuson et al. | |
| 6,085,454 | A | | 7/2000 | Caudle | |
| 6,364,135 | B1 | | 4/2002 | Sirois et al. | |
| 6,405,654 | B1 | | 6/2002 | Smith | |
| 6,540,092 | B2 | | 4/2003 | Sirios | |
| 6,604,311 | B1 | | 8/2003 | Laney et al. | |
| 7,140,138 | B1 | | 11/2006 | Laney et al. | |
| 7,621,064 | B2 | * | 11/2009 | Laney et al. | 42/51 |
| 2005/0115129 | A1 | * | 6/2005 | Lizarralde et al. | 42/51 |
| 2006/0248771 | A1 | * | 11/2006 | Richards | 42/51 |
| 2007/0137084 | A1 | * | 6/2007 | Laney et al. | 42/51 |

* cited by examiner

*Primary Examiner*—Bret Hayes
(74) *Attorney, Agent, or Firm*—David R. McKinney

(57) ABSTRACT

Various embodiments of a muzzleloader firearm system are claimed and described.

20 Claims, 14 Drawing Sheets

MUZZLELOADER FIREARM SYSTEM

PRIORITY CLAIM

The present application claims priority from U.S. provisional patent application Ser. No. 60/817,574, filed on Jun. 28, 2006, and entitled MUZZLELOADER HAVING A BREECH PLUG REMOVABLE WITHOUT TOOLS AND A PRIMER INSERTER/EXTRACTOR.

BACKGROUND

1. Field of the Invention

This disclosure relates generally to firearms and, more particularly, to muzzle-loading firearms having inline ignition systems and a removable breech plug.

2. Related Art

Early in 1968, U.S. President Lyndon B. Johnson signed into law the Omnibus Crime Control Bill, which included sundry curbs on handguns, including a ban on the interstate mail-order sale thereof. However, the President did not think that ban went far enough, and so he proposed new gun legislation targeting shotguns and rifles. After prolonged and heated debate, Congress finally enacted the strongest gun control legislation in the nation's history on October 22 of that year. As finally approved, the legislation: outlawed the mail-order sales of all rifles, shotguns, and ammunition, except between licensed dealers, manufacturers, and gun collectors; banned the sale of rifles, shotguns, and handguns to persons under 21 years of age; and banned direct sales of guns to out-of-state residents unless the state involved specifically authorized its citizens to buy guns in adjoining states. Muzzleloading, black-powder firearms, though, were exempted from most of the restrictive legislation.

During the past three decades, muzzleloading firearms have enjoyed a strong resurgence in popularity. Certainly, the federal exemptions from the ban on interstate mail order sales have helped. In addition, because black-powder firearms have significantly less range and are generally less accurate than smokeless, breech-loading firearms, most states have established special seasons for muzzleloader hunting that are more favorable than those allotted to breechloader hunters. However, the most significant factor in the growing popularity of muzzleloader firearms is almost certainly the challenge associated with the use of a single shot rifle during the hunt. Muzzle-loader hunters style themselves as an elite group. A single shot with a weapon of less range, at a quarry likely made wary by other hunters who came before you, has almost irresistible appeal for many. The allure of muzzleloading hunting is the same as that afforded by flyfishing: the greater the challenge, the greater the satisfaction. Today, there are two basic types of muzzleloaders used for hunting: primitive and in-line. Both types require the introduction of a measured powder charge into the gunbarrel, and the ramming of a slug or ball down on top of the charge to load the gun.

Primitive muzzleloaders generally use either a flintlock or a caplock ignition system. The flintlock, popular from the time of the Revolutionary War through the early 1800s, is the more primitive technology. The hammer of the gun holds a piece of flint wrapped in fine leather. Below the hammer is a swinging metal plate known as the frizzen. Below the frizzen is the pan, into which the shooter pours a small amount of fine black powder. Pulling the trigger releases the hammer, which strikes the frizzen, which then folds back, thereby showering the powder in the pan with sparks. The powder ignites, shooting a tongue of flame into the barrel of the gun via a small port. The powder charge in the barrel ignites, expelling the ball or slug that has been rammed down the barrel. The foregoing process is as cumbersome as it sounds. Ignition is neither instantaneous, nor certain. A full second or more may elapse between pulling the trigger and ignition of the measured charge. Flintlock shooters must remain steady for that period.

The caplock ignition system, though the more modern of the primitive technologies, still relies on a side hammer design and the funneling of a flame into a port in the barrel. However, ignition is accomplished through a small nipple seated under the hammer. A copper percussion cap filled with a small amount of priming compound is placed atop the nipple. When the hammer falls, the cap shoots a tiny spurt of hot flame through the nipple and into the port in the barrel, thereby igniting the powder inside and expelling the slug or ball from the barrel. Ignition of the loaded charge is much more direct and rapid than with the flintlock.

The special muzzleloader hunting seasons were originally established for the intended use of primitive percussion or flintlock rifles or shotguns, using black powder and open metal sights. These types of guns have specific limitations. Loading such a gun is considerably more cumbersome and time-consuming than loading cartridges into a breechloader. Thus, the hunter may get only one shot at his game, so he'd better make it count. This necessitates getting close to the quarry, learning to shoot well with open sights, and keeping the powder dry in inclement weather.

An in-line ignition muzzleloader, on the other hand, utilizes a plunger-type hammer, which strikes a nipple centered at the rear of the breech plug. An in-line ignition is quick and reliable because the fire from the cap travels a straight, short distance into the powder charge rather than bouncing around a corner as it does in a side hammer design. In all other respects, an in-line rifle loads and shoots identically to a traditional side hammer percussion muzzleloader. In-line rifles are nothing new. Some flintlocks used in-line ignition as far back as the 1700s, although the lack of sufficiently powerful springs to drive the in-line hammers probably kept them from supplanting side-hammer rifles. In the early 1970s and 1980s a couple of rifles, most notably the Michigan Arms Wolverine, featured an in-line ignition. The Wolverine, however, had a long, heavy octagonal barrel and never caught on with shooters.

Tony Knight, a gunsmith from rural Lancaster, Mo., is generally credited with building the first modern, lightweight, in-line blackpowder rifle. Knight was no traditionalist, and figured that any hunting rifle should be equipped with a tapered 22-inch barrel. Starting with a Numrich Arms barrel, Knight added a removable, friction-securable, threaded breech plug that simplified cleaning and allowed hunters to push an unfired charge out the breech instead of having to fire the rifle or pulling the ball back out of the barrel to unload it. He also incorporated Remington sights, a handmade trigger, and a stock carved from a piece of walnut cut from a tree on his farm. Knight's first in-line design, which he christened MK-85, is considered a milestone in muzzleloader technology.

Knight's new rifle set the standard for in-line models subsequently manufactured by hundreds of competitors, both large and small. The in-line rifle business is booming. One can now purchase a gun that looks and operates very much like a modern sporting rifle. In essence, it is a modern single-shot rifle that is loaded with a ramrod. Many in-line shooters use pelletized powder, such as those produced by Pyrodex®, that can be dropped into the barrel in 50-grain increments, and saboted bullets that are constructed much like a high-powered rifle bullet, but with a plastic sleeve which allows them to be more easily rammed down the barrel. With a shotgun primer, a #11 primer cap, a musket cap, or a primer adapted from a center-fire cartridge securable in the breech to ignite the propellent charge, rain and high humidity are much less problematic, especially if the firearm is fabricated from stainless steel. Many of these modern rifles, which may be fitted with scopes and other optical sights, are capable of groupings of one inch or less at a range of 100 yards.

The use of an in-line rifle, no matter how sophisticated the features, still means single-shot, front-loading, no-mistakes hunting. An in-line hunter accepts the same challenge of placing one well-aimed shot at relatively close range. Granted, a properly loaded, scoped in-line enjoys a big advantage in effective range over an open-sighted rifle shooting round-balls. In a sense, the in-line rifle is to blackpowder what the compound bow is to archery: easier to shoot and harder-hitting than traditional gear, yet subject to the same underlying limitations.

The present disclosure provides several new types of quickly removable breech plugs, as well as a mechanism for both inserting a fresh primer into a recess in the breech plug and extracting a spent primer therefrom. Breech plugs are used to stopper the barrel at the breech end thereof. All muzzleloading firearms do not have removable breech plugs. Early muzzleloading cannon barrels, for example, had the breech plug cast unitary with the barrel. On primitive muzzleloader rifles and pistols, the bore of the barrel does not extend to the breech. Because the combustion of black powder forms highly corrosive deposits in the barrel, frequent cleaning of muzzleloader firearms is essential.

For a muzzleloader having no breech plug, cleaning the barrel and extracting an unfired charge can be quite a chore. A removable breech plug greatly simplifies those tasks, as cleaning of the barrel is most easily effected by removing the plug and running a cleaning rod through the barrel from the muzzle into the breech. One of the problems associated with conventional threaded breech plugs is that removal of the plug requires the use of a wrench or other special tool. Threaded breech plugs typically have either a polygonal socket or shank which can be engaged with a wrench. For socket-type plugs, an appropriately-sized square or hexagonal Allen wrench is used; for shank type plugs, an appropriately-sized socket, box-end or open-end wrench is used. On an in-line rifle, the firing plunger assembly can be disassembled so that the plug may be accessed directly using an extension inserted through the end of the receiver. Although removal of the firing plunger requires the expenditure of additional time and effort, it facilitates removal of the breech plug. A break-open type receiver or falling block action muzzleloader can involve different steps to remove the breech plug, but also present difficulties with respect to removal of the breech plug. Thus, no matter which method is used, removal of a conventional threaded breech plug is, at the very least, a nuisance.

SUMMARY

It has been recognized that it would be advantageous to develop a new type of breech plug that may be quickly removed without tools.

Another problem related to black power firearms is the difficulty of removing spent primers (often referred to as primer caps) from the primer recess in the rear end of the breech plug. Most modern black powder rifles now use the readily available #209 shotgun primer. Difficult to manually remove from the recess before they are fired, they must invariably be pried from the recess with a tool after they are fired due to expansion of the brass primer casing. If extreme care is not used during the extraction process, the rifle will sustain some degree of mechanical damage.

It has also been recognized that it would be advantageous to have a mechanism for rapidly extracting a spent primer from the primer recess in the breech plug, which will eliminate any potential for damaging the firearm.

In various embodiments, the present invention provides a breech plug on a muzzleloader firearm that can be removed without tools in about one second. The ease and speed of removal not only facilitates cleaning of the barrel, but enables the shooter to easily expel misfired charges through the breech, rather than attempting to extract it through the muzzle. The present application also provides a mechanism for quickly and safely extracting primers from the primer recess in the breech plug. The primer extractor may be used with breech plugs of both the conventional threaded type and the new quickly-removable type.

The invention requires either a redesign the breech end of the barrel and the breech plug or a redesign of the threaded breech plug to accept an easily-removable breech plug. In one embodiment of the invention, the rifle's receiver is also modified to include a locking aperture on a forward edge of the breech access cutout. The barrel is provided with at least one lug retaining structure that includes an internal annular groove and an internal annular shoulder that is both adjacent the annular groove and positioned between the annular groove and the breech end of the barrel. Each annular shoulder is provided with lug entry cutouts, which are radially spaced about the shoulder. The breech plug is provided with multiple lugs forming at least one crenelated external shoulder. The lugs are spaced and sized so that they align with the lug entry cutouts in the barrel. The number of external shoulders on the breech plug can match the number of internal annular grooves in the barrel. The breech plug is installed in the barrel by aligning the lugs with the lug entry cutouts, and then rotating the plug so that the lugs are no longer aligned with the lug entry cutouts.

In addition to the rotational locking mechanism disclosed in the parent application, several new rotational locking mechanisms are disclosed, any of which may be successfully employed to rotationally lock the breech plug in its closed position. For a first locking mechanism, a ball bearing installed in a first cylindrical recess protrudes from the head of the breech plug and locks into a semi-cylindrical detent recess in the rear end of the barrel when urged into that position by a sliding spring-biased detent rod having a flattened cutout, the detent rod being maintained in a second cylindrical recess, perpendicular to and intersecting with the first, by a set screw that traps the flattened cutout. When the detent rod is depressed, the ball bearing retracts into the first cylindrical recess, thereby permitting the breech plug to be rotated to its open position. For a second locking mechanism, a pin having a 45-degree-angle driven tab intersects a spring-loaded sliding detent pin having a 45-degree-angle drive groove. The spring loading causes the sliding detent pin to urges the pin against the rifle barrel. When the sliding detent pin is depressed, the detent pin retracts the pin from the semi-cylindrical recess in the barrel, thereby permitting the breech plug to be rotated to its open position.

Various embodiments of the invention are shown and described. A first main embodiment utilizes a barrel having pair of lug retaining structures, which are axially positioned within the breech-end of the barrel, one behind the other. For this embodiment, the breech plug has two circular arrays of lugs, with the lugs of one circular array being aligned with those of the other circular array. Each lug retaining structure in the barrel has at least two lug entry cutouts, and each circular array of lugs on the breech plug has a number of lugs which correspond to the number of lug entry cutouts in a single lug retaining structure in the barrel. Lug retaining structures with up to four lug entry cutouts are shown and described. More are certainly possible, but increase the complexity and difficulty of the machining process, with little or no return for the added expenditure of effort. In fact, because radiused cuts are produced by most machine tools, the total amount of surface area available for lugs and lug retaining structures may actually decrease as the number of lugs increases. Although it is conceivable that a single lug entry cutout may be used for a single lug retaining structure, a breech plug having a single lug would be unable to radially distribute the load to the barrel, thereby resulting in a tipping force concentrated at a point on the outer edge of the breech plug. In addition, greater axial rotation of the plug in an arc of up to 180 degrees would be required to achieve an optimum load handling capability. Therefore, although a breech plug having a single lug or multiple longitudinally-aligned lugs has been contemplated, and is covered by the claims of this patent, it is not considered to be a preferred embodiment of the invention, as there are other alternatives that require far less axial rotation and provide balanced radial distribution of the load from a fired charge.

A second main embodiment breech plug and barrel combination is also shown and described, in which the barrel has only a single lug retaining structure and the breech plug has only a single circular array of lugs. As with the first main embodiment of the invention, the circular array may have two or more lugs. A breech plug having four equiangularly-spaced lugs per circular array requires axial rotation of about 45 degrees to provide maximum load distribution within the barrel; with three lugs per circular array, the angle of rotation is about 60 degrees; and with two lugs per circular array, the angle of rotation is about 90 degrees.

Both main embodiments of the breech plug may be used in combination with the various types of ignition systems that are currently used and may be used in the future to ignite the powder charge in the barrel. All embodiments of the lugged breech plug, which is one component of the present invention, may be modified to accept the various types of available primer caps including, but not limited to, #11 caps, musket caps, shotgun primer caps, rifle primer caps and pistol primer caps. Although the design of center-rear portion of the lugged breech plug must be specifically modified to accept the various types of primers, the lugged structure which permits quick removal of the plug is entirely unaffected by such modifications.

Although a detent pin is used to lock the breech plug of the present invention within the rifle barrel, it should be understood that this is only one of many possible mechanisms. For example, a clamping mechanism could be substituted, as could a friction screw lock. The detent pin method is advantageous because it is simple, reliable, and visually verifiable. Movement of the detent pin release lever as the detent pin locks in place provides a verifiable indication of the locked-in-place condition.

In some embodiments of the breech plug the lugs are unitary with a shank portion that has a diameter only slightly less than the barrel bore diameter. This clearance is, ideally, just sufficient to provide a non-interference sliding fit. A circumferential shoulder portion is positioned between and unitary with both the shank portion and a head portion. The circumferential shoulder portion, which fits into a recess at the breech end of the barrel, complicates the exit route of any combustion gases which may escape through the clearances between the breech plug and the barrel by diverting them around two 90-degree corners. The breech end of the barrel is also equipped with an annular lip that fits into a circumferential groove in the head portion of the breech plug, thereby routing any escaping gases around three additional 90-degree corners. Using these techniques, the leakage of combustion gases between the rife bore and the periphery of the breech plug is minimized. Other types of gas seals may also be used. One or more O-ring seals, a compressible metal sealing ring, or a crushable metal sealing ring may also be used in place of, or in combination with escape route diversion seals.

For a lever action rifle, which incorporates action lugs in the receiver which retain and lock the slide before it is fired, a breech plug (at least theoretically) need not be designed to withstand any of the explosive force which propels the bullet. Thus, a single circular array of lugs on the breech plug is more than adequate. In addition, as the action lugs are designed to withstand the explosive force in the barrel, even a single lug breech plug would suffice, as the slide would prevent any tipping of such an asymmetrical breech plug.

For another embodiment of the invention, a conventional threaded breech plug is replaced by a modified primary threaded breech plug, which is intended to remain either permanently or semi-permanently installed within the breech end of the barrel. The modified breech plug is provided with a lug retaining structure, similar to those provided for the breech end of the barrel as heretofore described. A secondary lugged breech plug is then provided which is insertable in the primary breech plug. It may then be rotated 90 degrees or less to lock it in place within the modified primary threaded breech plug.

Other alternative embodiments of a quickly removable breech plug are also disclosed. For one such embodiment, the breech end of the barrel is smaller than the muzzle end. A breech plug is rammed down the muzzle end of the barrel and secured from the breech end thereof with, for example, a snap ring locking pin, or other equivalent retaining device.

A second alternative embodiment of a quickly removable breech plug is insertable from the breech end of the barrel and is held in place by a snap ring accessible through an recess in the breech plug.

A third alternative embodiment of a quickly removable breech plug, which is also insertable from the breech end of the barrel, uses a double-helix Acme thread for rapid insertion. Because of the rotational loads imposed on the plug, the plug's rotational locking device must be able to handle the torque imposed on the plug by firing explosions in the barrel. A stout locking pin braced against an upper edge of the receiver, for example, would be able to withstand the torque.

BRIEF DESCRIPTION OF THE DRAWINGS

Additional features and advantages of the invention will be apparent from the detailed description which follows, taken in conjunction with the accompanying drawings, which together illustrate, by way of example, features of the invention, and wherein.

DETAILED DESCRIPTION

Figure 1:
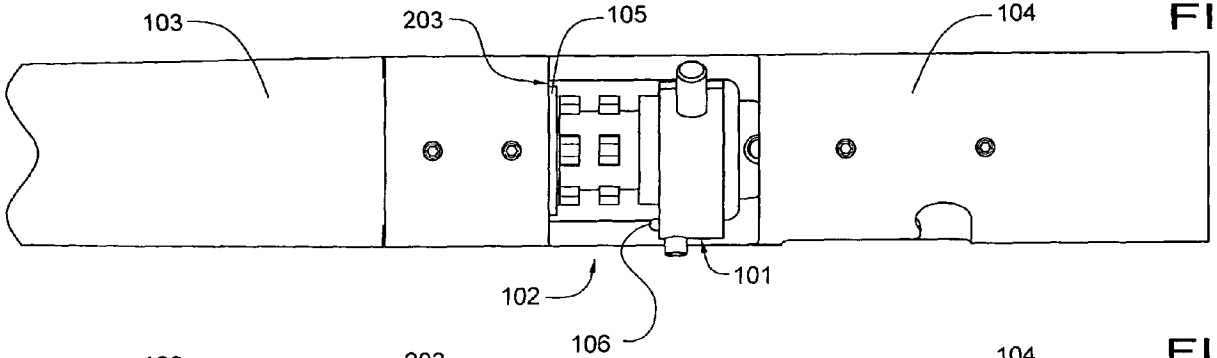
FIG. 1 is a top plan view of a tapered muzzleloader rifle barrel and slide-action receiver assembly, together with a non-friction-fit eight-lug breech plug adapted for use with #209 shotgun primer that has been placed within the receiver chamber, but before the insertion thereof into the breech of the rifle barrel.

Reference will now be made to exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

It should be understood that the drawings are not necessarily drawn to scale and are intended to be merely illustrative. The invention should not be considered limited to any particular caliber or even to shoulder-fired weapons. The invention is as applicable to muzzleloader handguns as it is to muzzleloader rifles.

Referring now to FIG. 1, a non-friction-fit eight-lug breech plug 101, adapted for use with a #209 shotgun primer, has been placed in the chamber of a muzzleloader rifle 102 having a tapered barrel 103 and slide-action receiver 104. The breech plug 101 has not yet been inserted into the breech 105 of barrel 103. The detent pin 106 is used to lock the breech plug 101 within the breech 105. The breech plug 101, its structure and operation are disclosed in U.S. utility patent application Ser. No. 11/122,668 by the same inventor, which was filed on May 4, 2005.

Figure 2:
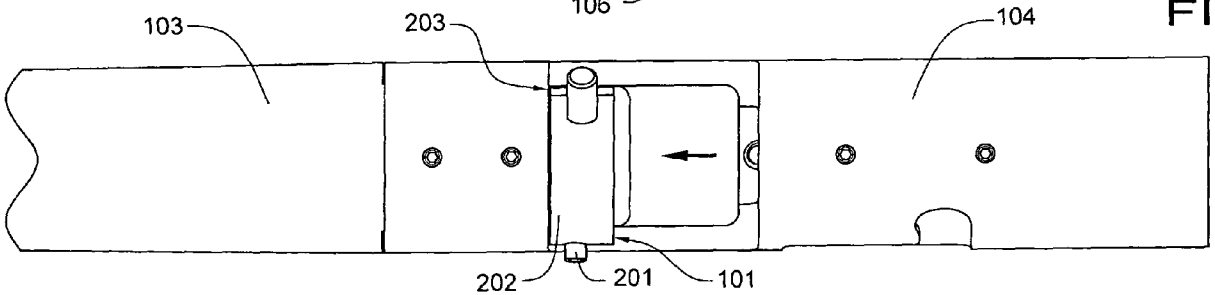
FIG. 2 is a top plan view of the rifle barrel and slide-action receiver assembly of FIG. 1, subsequent to insertion of the breech plug into the breech of the rifle barrel, but before it is rotated to lock it into place.

Referring now to FIG. 2, the breech plug 101 has been inserted into the breech 105 of the rifle barrel 103, but has not yet been rotated to lock it into place. It will be noted that the detent pin socket-head retaining screw 201 has been moved rearward, thereby retracting the detent pin 106 into the locator flange 202 as the locator flange 202 is pressed against the forward upper edge 203 of the receiver 104.

Figure 3:
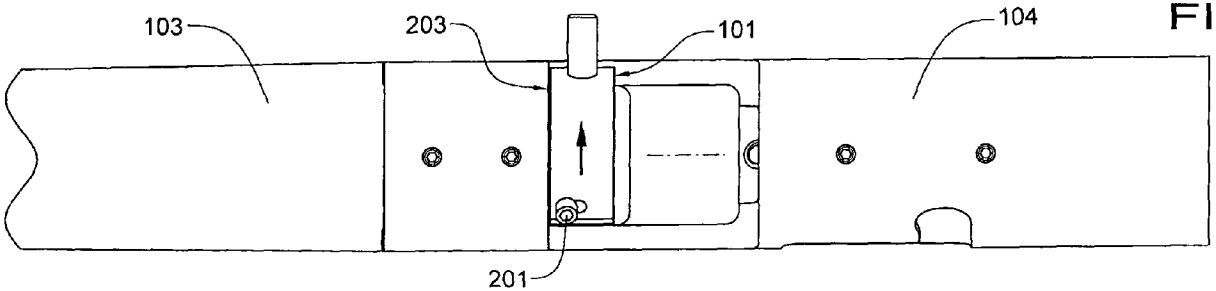
FIG. 3 is a top plan view of the rifle barrel and slide-action receiver assembly of FIG. 2, subsequent to axial rotation of the breech plug to lock it into the breech of the barrel.

Referring now to FIG. 3, the breech plug 101 has been rotated 45 degrees in order to misalign the lugs eight lugs (not shown) with the lug entry cutouts in the breech 105 of the barrel 103. Once fully misaligned, the detent pin locks into a detent pin aperture (not shown) in the breech end 204 of the barrel 103, as evidenced by the forward movement of the socket head retaining screw 201.

Figures 4, 5, 6:
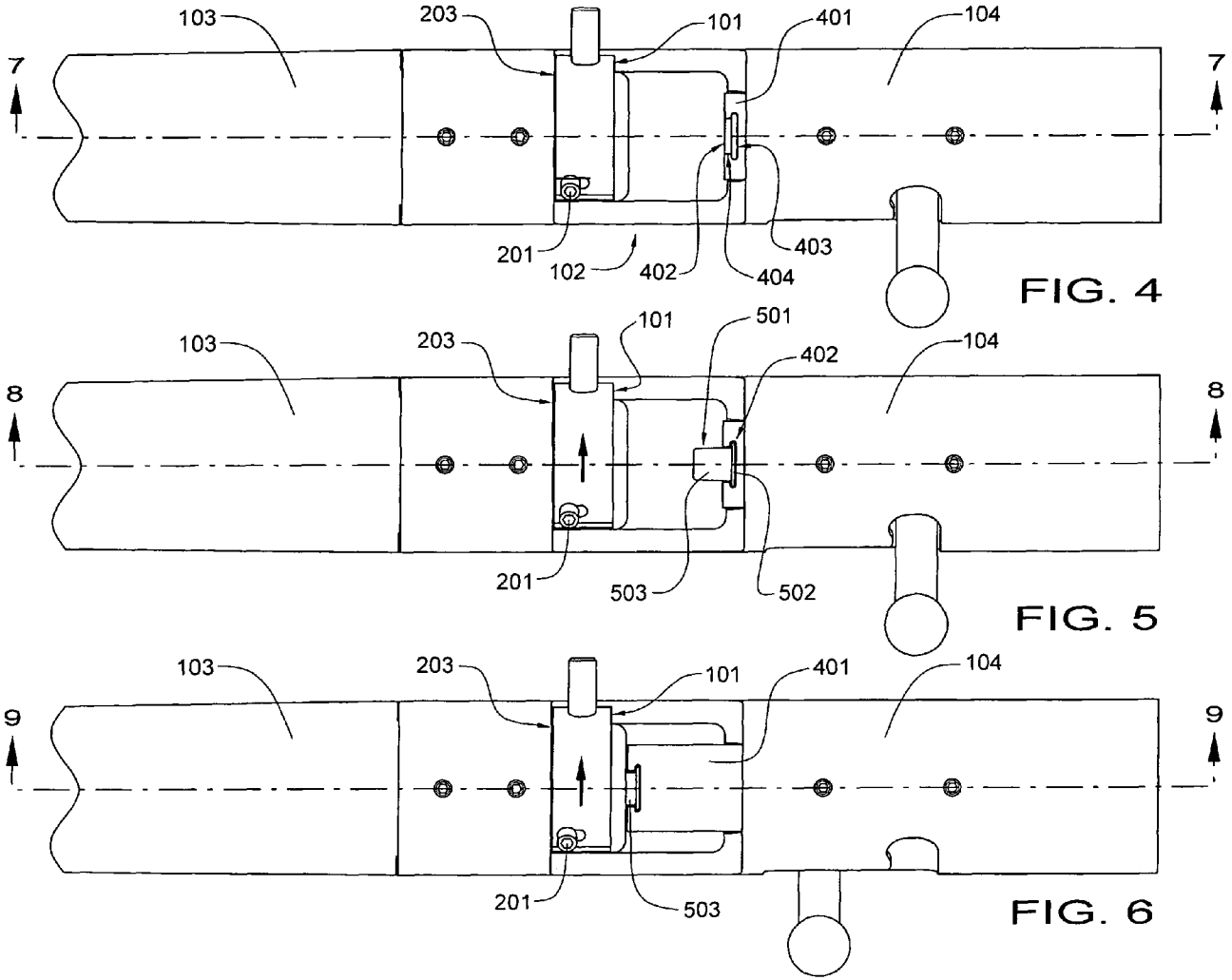
FIG. 4 is a top plan view of the rifle barrel and slide-action receiver assembly of FIG. 3, with an action slide having a primer inserter/extractor installed in the receiver.
FIG. 5 is a top plan view of the rifle barrel and slide-action receiver assembly of FIG. 4, subsequent to loading a primer in the primer inserter/extractor slot.
FIG. 6 is a top plan view of the rifle barrel and slide-action receiver assembly of FIG. 5, subsequent to moving the action slide forward so that the primer is installed in a recess in the breech plug.

Referring now to FIG. 4, an action slide 401 has been installed in the receiver 104 of the rifle 102, only the front end of which is visible. It will be noted that the action slide incorporates primer inserter/extractor 402, which includes a slot 403 for the primer flange and a notch 404 for the primer nipple.

Referring now to FIG. 5, a #209 shotgun primer 501 has been loaded into the inserter/extractor 402. The primer flange 502 and primer nipple 503 are clearly visible in this view.

Referring now to FIG. 6, the action slide 401 has been moved forward so that the nipple 503 of the primer 501 is installed in the primer recess (not shown in this view) of the breech plug 101.

Figure 7:
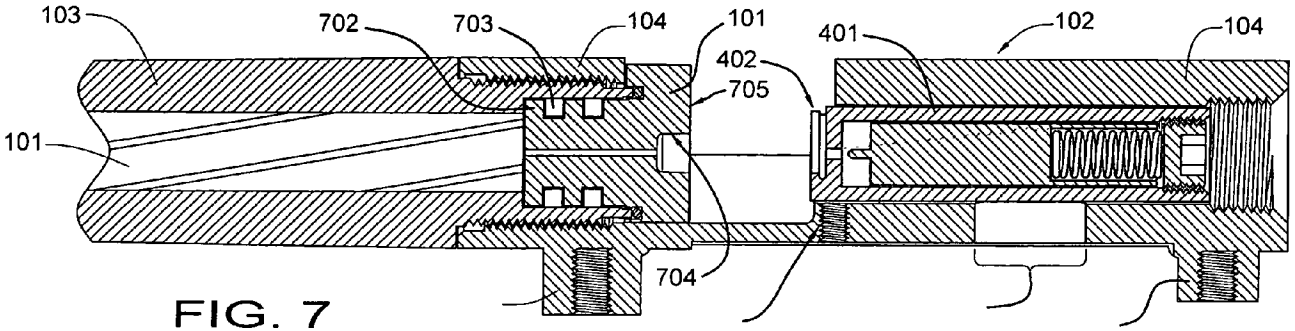
FIG. 7 is a cross-sectional view of the rifle barrel and slide-action receiver assembly of FIG. 4, taken through a vertical plane 7-7 passing through the barrel axis.
Figure 8:
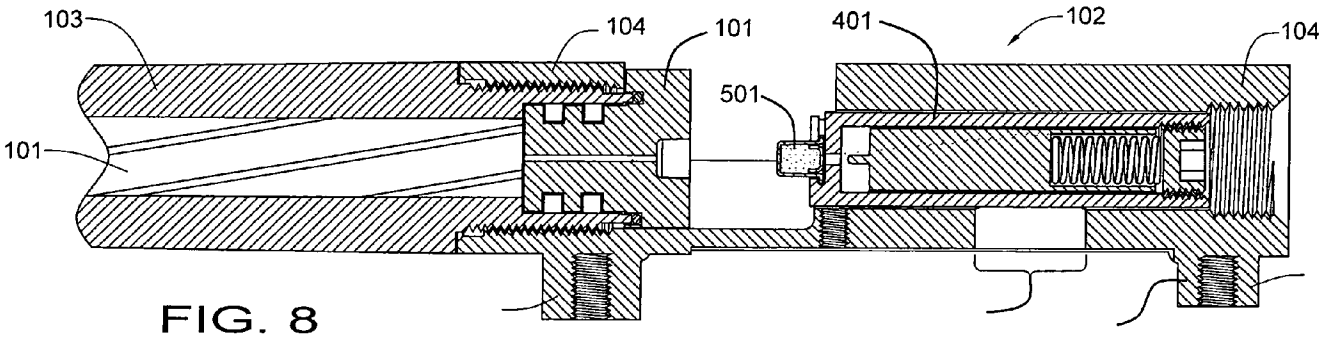
FIG. 8 is a cross-sectional view of the rifle barrel and slide-action receiver assembly of FIG. 4, taken through a vertical plane 8-8 passing through the barrel axis, subsequent to loading a primer in the primer inserter/extractor.
Figure 9:
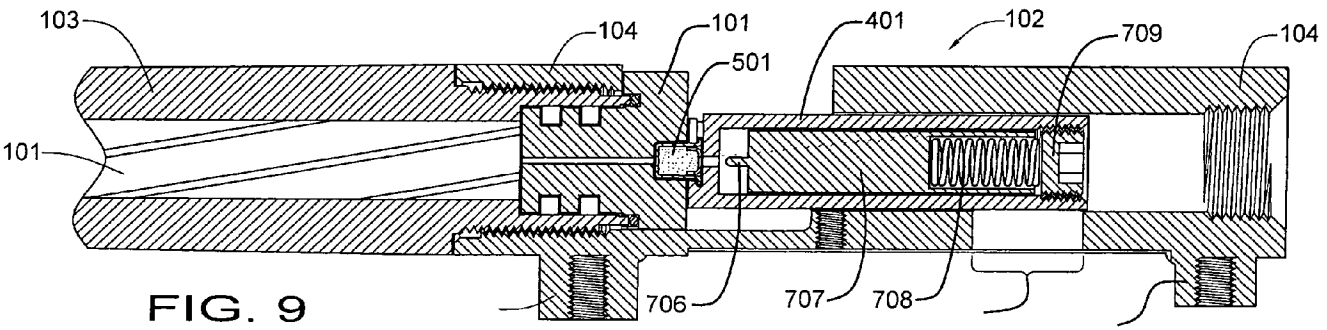
FIG. 9 is a cross-sectional view of the rifle barrel and slide-action receiver assembly of FIG. 4, taken through a vertical plane 9-9 passing through the barrel axis, subsequent to moving the action slide forward so that the primer is installed in a recess in the breech plug.

Referring now to FIGS. 7 through 9, it should be evident that these drawing Figures correspond to FIGS. 4 through 6. The cross-sectional nature of FIGS. 7 through 9 show additional features not visible in the top plan views of FIGS. 4 through 6. Additional features that are visible include the rifle bore 701, the lugs 702 of the breech plug 101, the lug-retaining structure 703 of the breech 105 of the barrel 103, the primer recess 704 in the aft end 705 of the breech plug 101, the approximate internal structure of the #209 primer 501, the slot 403 and notch 404 of the primer inserter/extractor 402, the firing pin 706, plunger 707, spring 708 and end plug 709 of the action slide 401.

Figure 10:
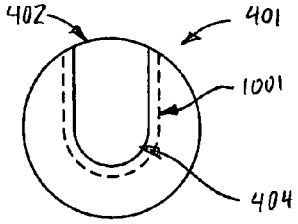
FIG. 10 is a front elevational view of an action slide equipped with a primer inserter/extractor.

Referring now to FIG. 10, the action slide 401 of FIGS. 4 through 9 is shown from the front, before a primer is loaded therein. The dashed (hidden) line 1001 shows the outline of the slot 403 of the inserter/extractor 402. The notch 404 thereof is also clearly visible.

Figure 11:
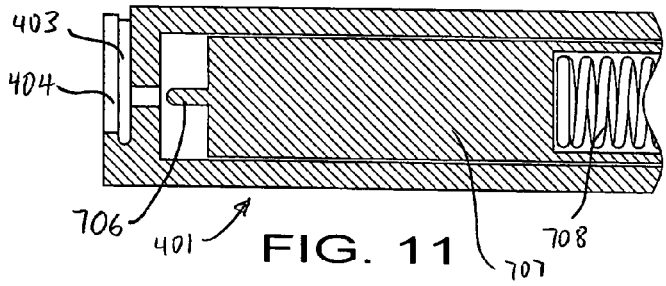
FIG. 11 is a cross-sectional view of an action slide equipped with a primer inserter/extractor.

Referring now to FIG. 11, the slot 403 and notch 404 of the inserter/extractor 402 of the action slide 401 are clearly visible in this cross-sectional view.

Figure 12:
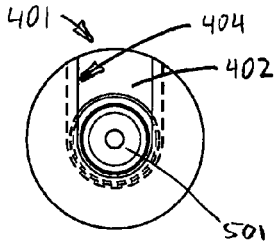
FIG. 12 is a front elevational view of the action slide of FIG. 10, subsequent to the loading of a primer in the primer inserter/extractor slot.

Referring now FIG. 12, a #209 primer 501 has been loaded into the inserter/extractor 402. It will be noted that there is adequate clearance between the primer flange 502 and the slot 403, so that the primer 501 slides easily into the slot 403. The primer nipple 502 projects through the notch 404.

Figure 13:
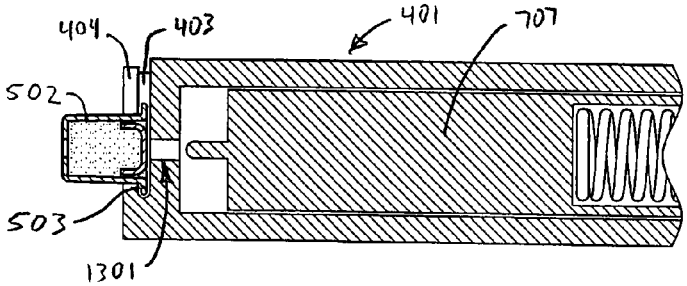
FIG. 13 is the cross sectional view of the action slide of FIG. 11, subsequent to loading a primer in the primer inserter/extractor slot.

Referring now to FIG. 13, the primer 501 is shown loaded into the inserter/extractor 402. It will be noted that the firing pin 706, which is unitary with the plunger 707, will be propelled through the aperture 1301 in the action slide 401 by the spring 708 when the seer (not shown) releases the plunger.

Figure 14:
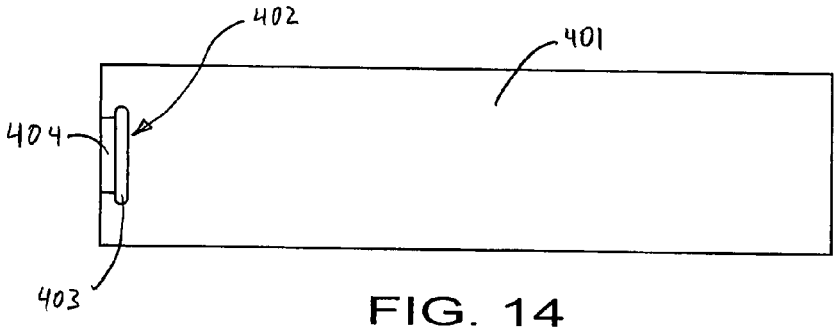
FIG. 14 is a top plan view of the action slide of FIG. 11.

Referring now to FIG. 14, this is an enlarged top view of the action slide 401 removed from the receiver 104 before a primer is loaded into the inserter/extractor 402.

Figure 15:
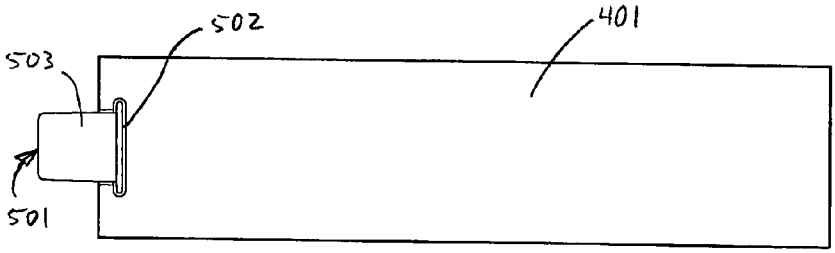
FIG. 15 is a top plan view of the action slide of FIG. 11, subsequent to loading a primer in the primer inserter/extractor slot.
Figure 16:
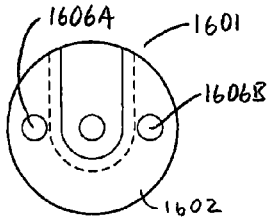
FIG. 16 is a front elevational view of a fully-assembled 4-piece primer inserter/extractor that fits within a shallow cylindrical recess in an action slide or action bolt.
Figure 17:
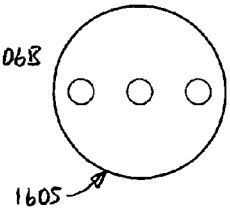
FIG. 17 is an elevational view of the rear plate of the primer inserter/extractor of FIG. 16.
Figure 18:
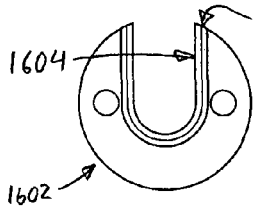
FIG. 18 is a rear elevational view of the front plate of the primer inserter/extractor of FIG. 16.
Figure 19:
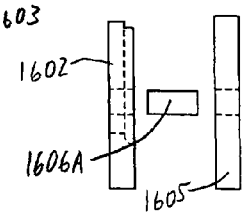
FIG. 19 is an exploded side elevational view of the primer inserter/extractor of FIG. 16.
Figure 20:
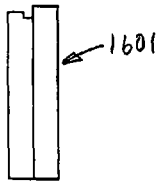
FIG. 20 is a side elevational view of the fully-assembled primer inserter/extractor of FIG. 16.
Figure 21:
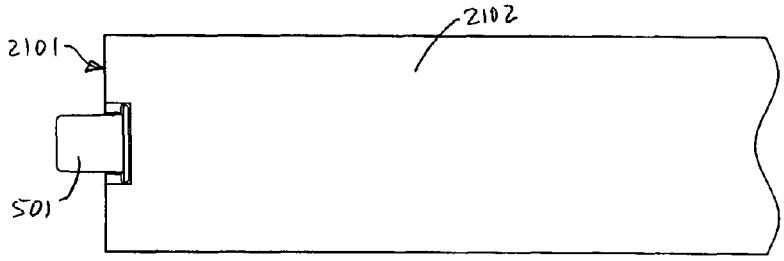
FIG. 21 is a top plan view of an action slide or action bolt having a shallow cylindrical recess in which has been installed the primer inserter/extractor of FIG. 16.
Figure 22:
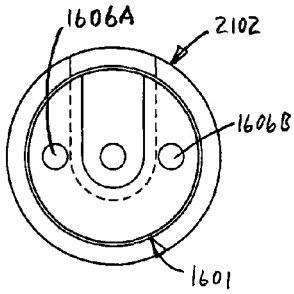
FIG. 22 is a front elevational view of the action slide or action bolt of FIG. 21, in which has been installed the primer inserter/extractor of FIG. 16.
Figure 23:
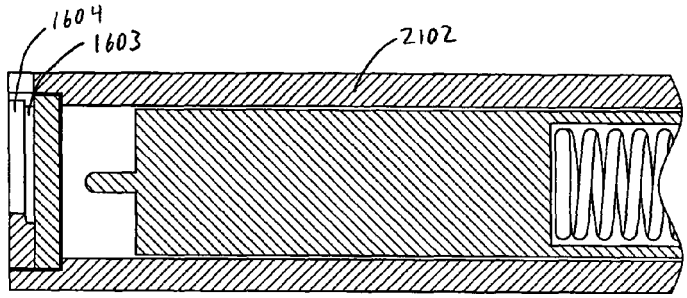
FIG. 23 is a cross-sectional view of the action slide or action bolt of FIG. 22, taken through a vertical plane passing through the longitudinal axis thereof.
Figure 24:
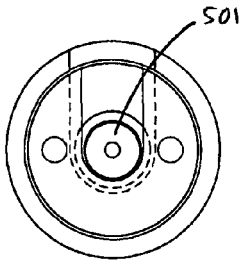
FIG. 24 is a front elevational view of the action slide or action bolt of FIG. 22, subsequent to loading a primer within the primer slot of the primer inserter/extractor.
Figure 25:
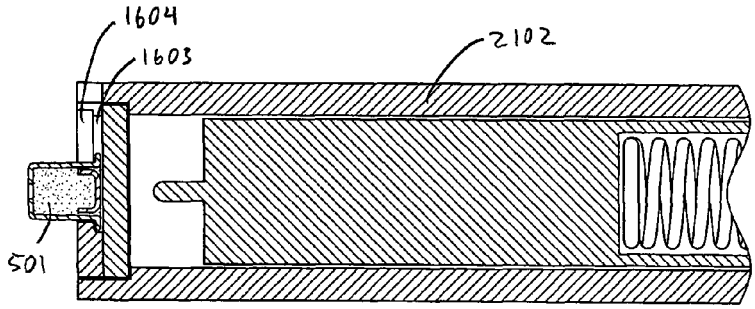
FIG. 25 is a cross-sectional view of the action slide or action bolt of FIG. 22, taken through a vertical plane passing through the longitudinal axis thereof, and subsequent to loading a primer within the primer slot of the primer inserter/extractor.

Referring now to FIG. 15, this is an enlarged top view of the action slide 401, subsequent to loading a primer 501 into the primer inserter/extractor 401.

Referring now to FIGS. 16 through 20, a primer inserter/extractor 1601 has been designed for the retrofitting of existing action slides. The primer inserter/extractor 1601 may be machined as two major pieces: a circular front plate 1602, in which is cut a slot 1603 for the primer flange 502 and a notch 1604 for the primer nipple 503; and a circular rear plate 1605, which are pinned together with a pair of pins 1606A and 1606B.

Referring now to FIGS. 21 through 25, the primer inserter/extractor 1601 has been installed within a recess (not shown) that is machined into the front portion 2101 of the action slide or action bolt 2102. Functionality of the retrofit primer inserter/extractor 1601 is identical to that of the primer inserter/extractor 402 that is incorporated into the action slide 401 of FIG. 4.

Figure 29:
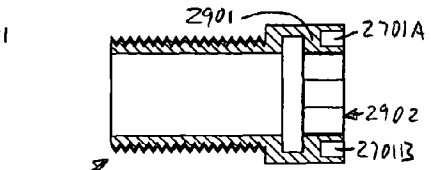
FIG. 29 is a cross-sectional view of the threaded adapter of FIG. 26, taken through a vertical plane passing the longitudinal axis thereof.
Figure 33:
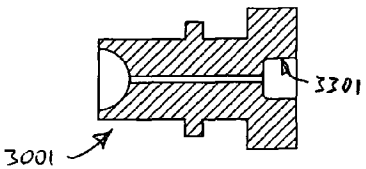
FIG. 33 is a cross-sectional view of the lugged breech plug of FIG. 30, taken through a vertical plane passing the longitudinal axis thereof.
Figure 28:
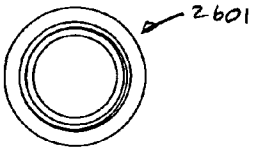
FIG. 28 is a front elevational view of the threaded adapter of FIG. 26.
Figure 32:
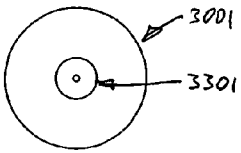
FIG. 32 a rear elevational view of the lugged breech plug of FIG. 30.
Figure 36:
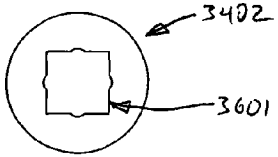
FIG. 36 is a rear elevational view of the pin wrench of FIG. 34.
Figure 27:
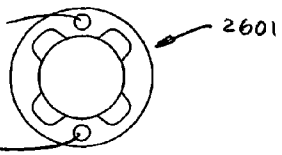
FIG. 27 is a rear elevational view of the threaded adapter of FIG. 26.
Figure 31:
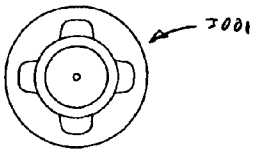
FIG. 31 is a front elevational view of the lugged breech plug of FIG. 30.
Figure 35:
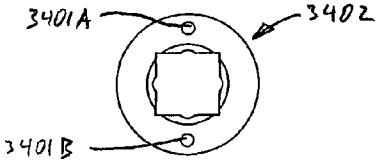
FIG. 35 is a front elevational view of the pin wrench of FIG. 34.
Figure 26:
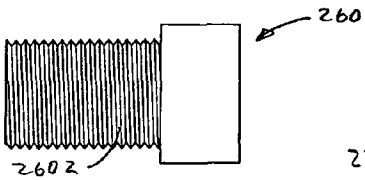
FIG. 26 is a side elevational view of a threaded adapter which replaces a convention threaded breech plug.
Figure 30:
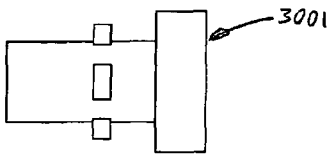
FIG. 30 is a side elevational view of a lugged breech plug that is securable within a rear portion of the threaded adapter of FIG. 26.
Figure 34:
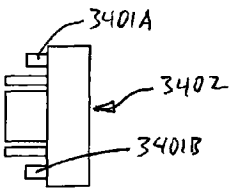
FIG. 34 is a side elevational view of a pin wrench used to install the threaded adapter in the breech end of a barrel.
Figure 37:
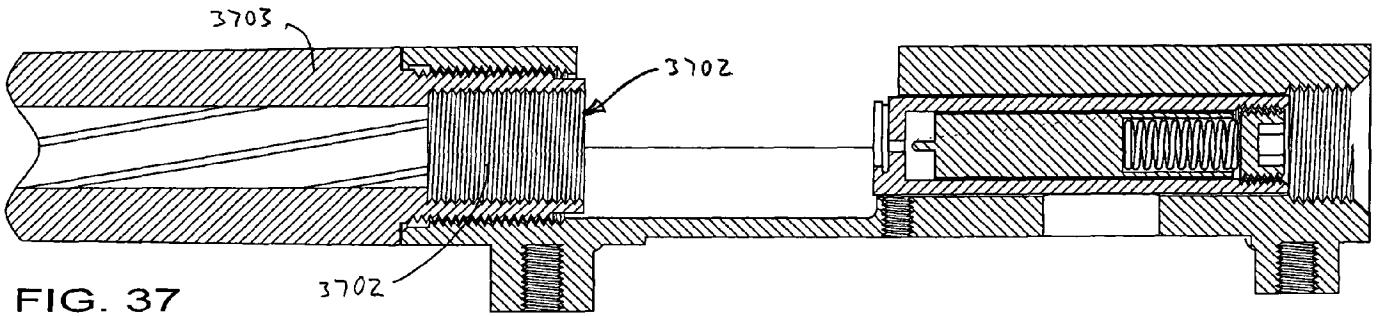
FIG. 37 is a cross-sectional view of a gun barrel, receiver and action slide or action bolt assembly having a primer inserter/extractor, taken through a vertical plane passing through the longitudinal axis thereof.
Figure 38:
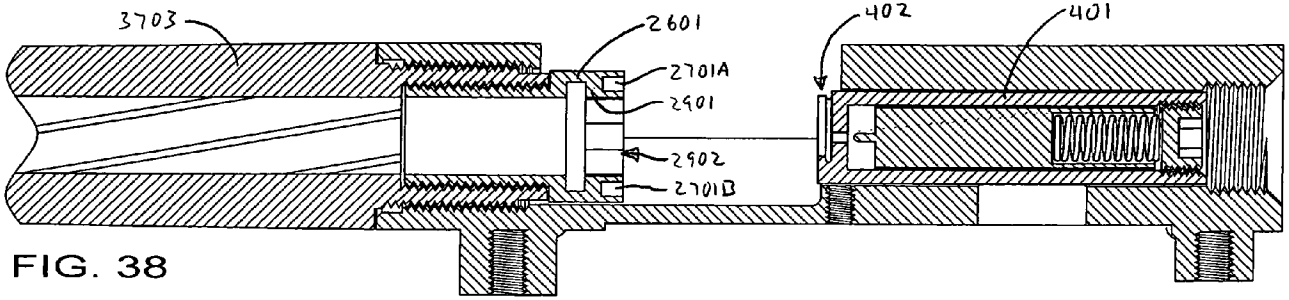
FIG. 38 is the cross-sectional view of FIG. 37, subsequent to installing the threaded adapter in the breech end of the barrel.
Figure 39:
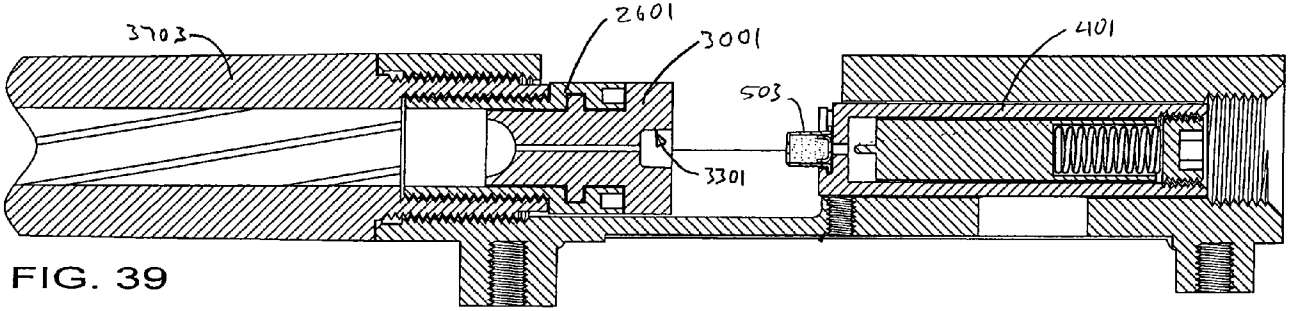
FIG. 39 is the cross-sectional view of FIG. 38, subsequent to installing the lugged breech plug in the threaded adapter and loading a primer into the inserter/extractor slot.
Figure 40:
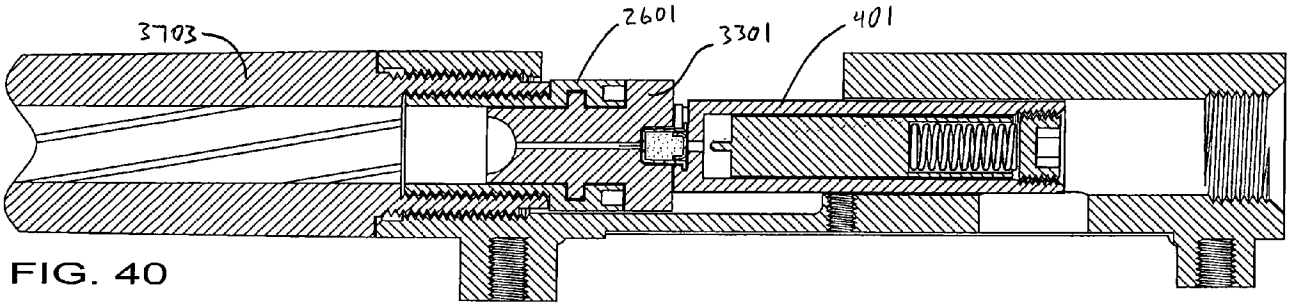
FIG. 40 is the cross-sectional view of FIG. 39, subsequent to moving the action slide or bolt forward so that the primer is inserted within a recess in the lugged breech plug.
Figure 41:
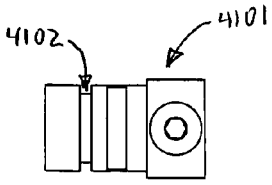
FIG. 41 is a top plan view of a double-lug breech plug designed for use in a lever-action muzzleloader rifle.
Figure 42:
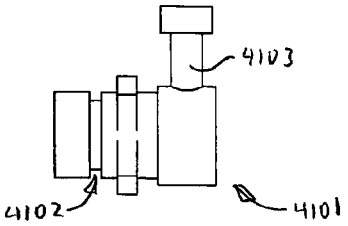
FIG. 42 is a side elevational view of the double-lug breech plug of FIG. 41.
Figure 43:
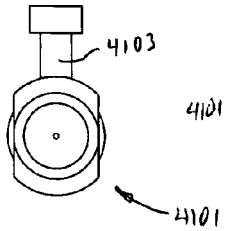
FIG. 43 is a front elevational view of the double-lug breech plug of FIG. 41.
Figure 44:
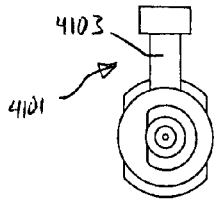
FIG. 44 is a rear elevational view of the double-lug breech plug of FIG. 41.

Referring now to FIGS. 26 through 40, various components for a quickly-removable breech plug for retrofitting a rifle barrel that is equipped with a conventional threaded breech plug are shown. A retrofit adapter 2601 is provided which installs in the threaded breech end 3701 of the barrel 3702. The retrofit adapter is shown as a side view in FIG. 26, as a rear view in FIG. 27, as a front view in FIG. 28 and as a cross-sectional view in FIG. 29. The retrofit adapter 2601 incorporates a threaded anterior end 2602 that engages the threads 3701 in a rifle barrel having a conventional threaded breech, a lug retaining structure 2901 and a pair of apertures 2701A and 2701B which are engaged by the pins 3401A and 3401B of pin wrench 3402 of FIGS. 34 through 36. The pin wrench has a square aperture 3601 which can be engaged by the square drive of a ratchet or extension (not shown). Once the retrofit adapter 2601 is tightened in the breach end 3702 of the barrel 3703 with the pin wrench 3402, a lugged breech plug 3001 shown in FIGS. 30 through 33 can be installed in the aft end 2902 of the retrofit adapter 2601. The lugged breech plug 3001 is pushed into the aft end of the retrofit adapter 2601, then rotated 45 degrees so that the lugs 3101 will engage the lug retaining structure 2901 of the retrofit adapter 2601. The lugged breech plug 3001, as shown, incorporates a recess 3301 sized to receive the nipple of the primer 501. FIG. 38 shows the retrofit adapter 2601 installed in the rifle barrel 3702. FIG. 39 shows the lugged breech plug 3001 installed in the retrofit adapter 2601 and a primer 501 installed in the primer inserter/extractor 402. FIG. 39 shows the action slide 401 moved forward so that the primer nipple 503 is inserted in the primer recess 3301 of the lugged breech plug 3001.

Referring now to FIGS. 41 to 44, due to the narrowness of the interior of a typical lever-action muzzleloader rifle, a double-lug breech plug 4101 is employed because of its narrow profile. The double-lug breech plug 4101 has an O-ring groove 4102 for improved sealing between the breech plug 4101 and the breech of the barrel. The double-lug breech plug 4101 is also equipped with a post 4103, which facilitates axial rotation of the plug 4101. It will be noted that in FIG. 44, the rear end of the double-lug breech plug 4101 is provided with a D-shaped aperture 4104, which engages the primer inserter/extractor when in only one angular position, thereby assuring that the breech plug 4101 is in a locked position. A primer recess 4105 for receiving the nipple 503 of a primer 501 is centered within the D-shaped aperture.

Figure 45:
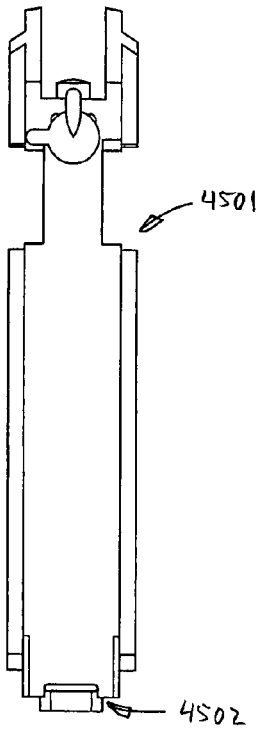
FIG. 45 is a top plan view of an action slide used for a lever-action muzzleloader rifle which incorporates a primer inserter/extractor of the present invention.
Figure 46:
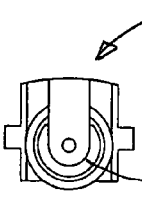
FIG. 46 is a front elevational view of the action slide of FIG. 45.
Figure 47:
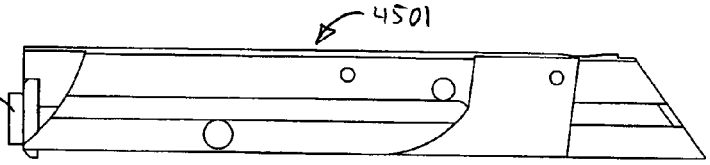
FIG. 47 is a side elevational view of the action slide of FIG. 45.

Referring now to FIGS. 45 through 47, an action slide 4501 of a typical lever-action muzzleloader has been equipped with a primer inserter/extractor 4502 that fits into the D-shaped aperture 4101 at the rear of the double-lug breech plug 4101 in only one angular position.

Figure 48:
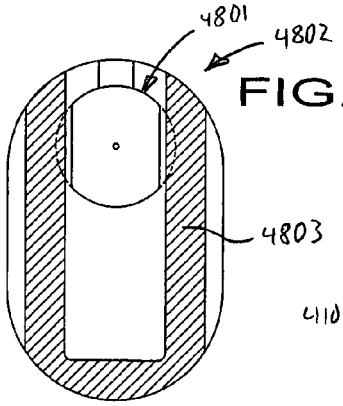
FIG. 48 is a cross-sectional view of the lever-action muzzleloader rifle of FIG. 50, taken through section line 48-48 thereof.

Referring now to FIG. 48, the observer is looking down the bore 4801 of a lever-action muzzleloader rifle 4802 that has been sectioned through the receiver 4803. The rifle 4802 has been adapted to receive the double-lug breech plug 4101 of FIGS. 41 to 44.

Figure 49:
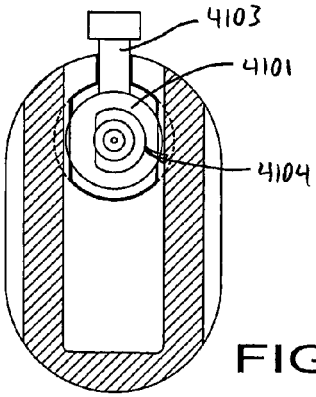
FIG. 49 is a view of FIG. 48, subsequent to the insertion of the double-lug breech plug of FIGS. 41-44 in the barrel breech.

Referring now to FIG. 49, the double-lug breech plug 4101 has been inserted into the breech end of the barrel of the lever-action muzzle loader rifle.

Figure 50:
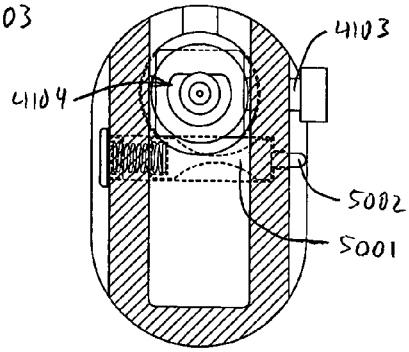
FIG. 50 is a view of FIG. 49, subsequent to a 90-degree, clockwise, axial rotation of the double-lug breech plug in the barrel breech.

Referring now to FIG. 50, the double-lug breech plug 4101 has been axially rotated 90 degrees to a locking position. Locking of the breech plug 4101 in the barrel is accomplished by means of a spring-loaded hourglass-shaped slidable pin 5001, which is shown in dashed (hidden) lines. When the right end of the slidable pin 5001 is depressed, the hourglass profile aligns with the lug.

Figure 51:
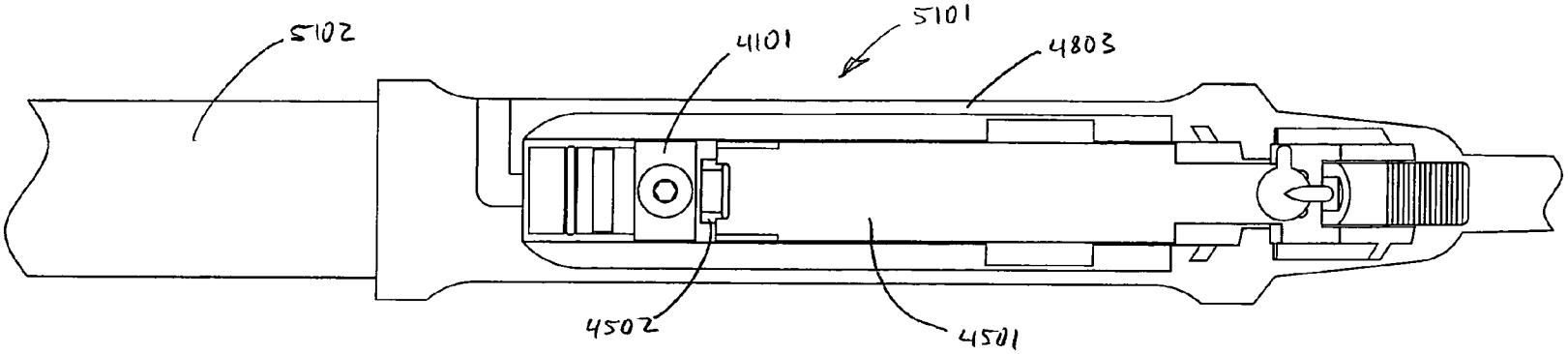
FIG. 51 is a top plan view of the barrel, receiver and action assembly of a lever-action muzzleloader rifle which incorporates both a lugged breech plug and a primer inserter/extractor, the action slide thereof having being moved rearward and the breech plug inserted in the resulting receiver cavity.

Referring now to FIG. 51, a lever-action muzzleloader rifle 5101 incorporates the double-lug breech plug 4101 of FIGS.

41 to 44, a barrel 5102 having a breech end modified to accept the lugged breech plug 4101, and the action slide 4501 of FIGS. 45 to 47, which has a primer inserter/extractor 4502 at the fore end thereof. In this view, the action slide 4501 has been moved rearward, and the lugged breech plug 4101 has been positioned within the receiver recess 5103.

Figure 52:
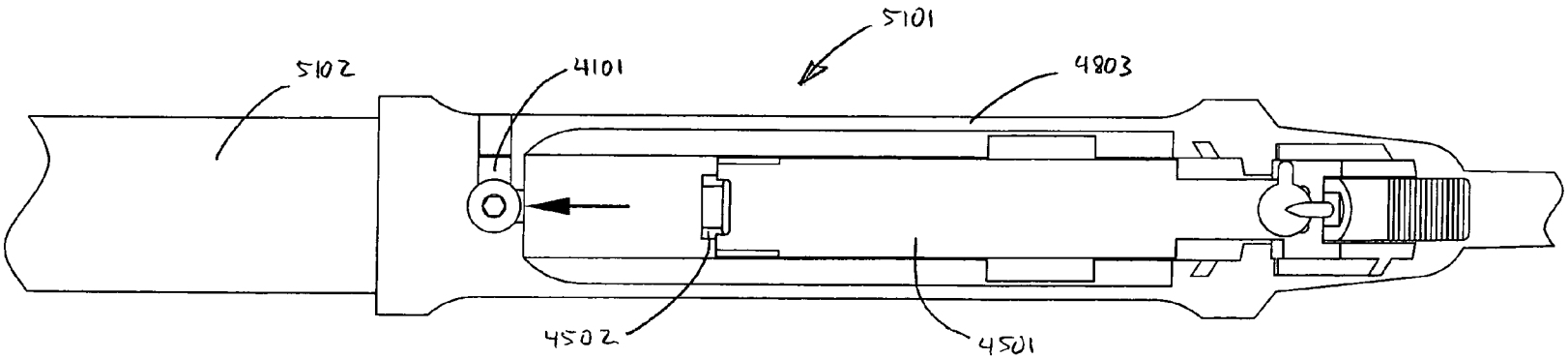
FIG. 52 is a top plan view of the barrel, receiver and action assembly of FIG. 51, subsequent to the breech plug being inserted into the breech end of the barrel.

Referring now to FIG. 52, the double-lug breech plug 4101 has been moved forward so that the lugs thereof are positioned within the lug retaining structure at the breech end of the barrel 5102.

Figure 53:
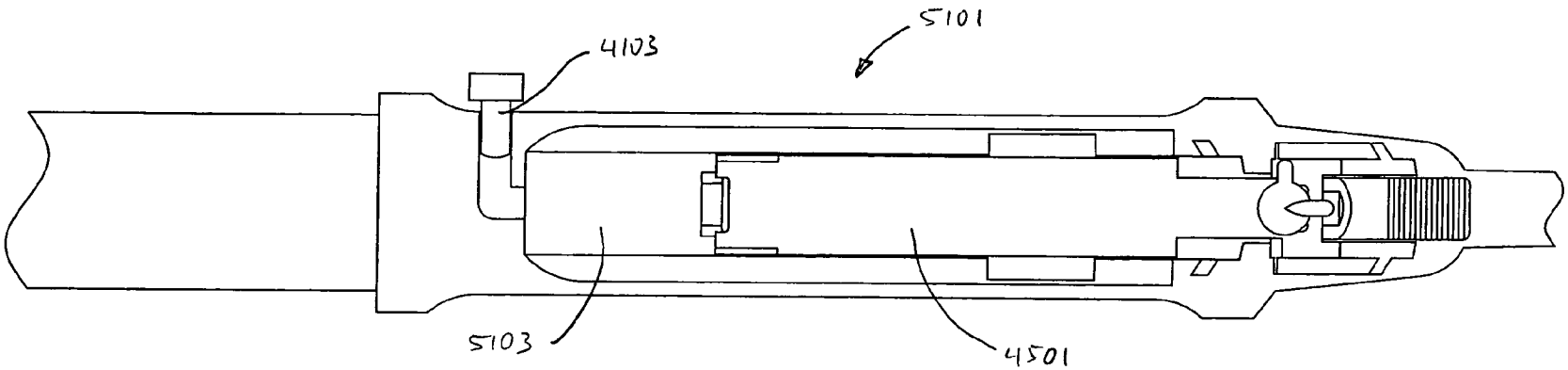
FIG. 53 is a top plan view of the barrel, receiver and action assembly of FIG. 52, subsequent to the breech plug being axially rotated 90 degrees in a clockwise direction (viewing the rear end of the breech plug)

Referring now to FIG. 53, the double-lug breech plug 4101 has been axially rotated 90 degrees so that the lugs of the plug 4101 are trapped within the lug retaining structure.

Figure 54:
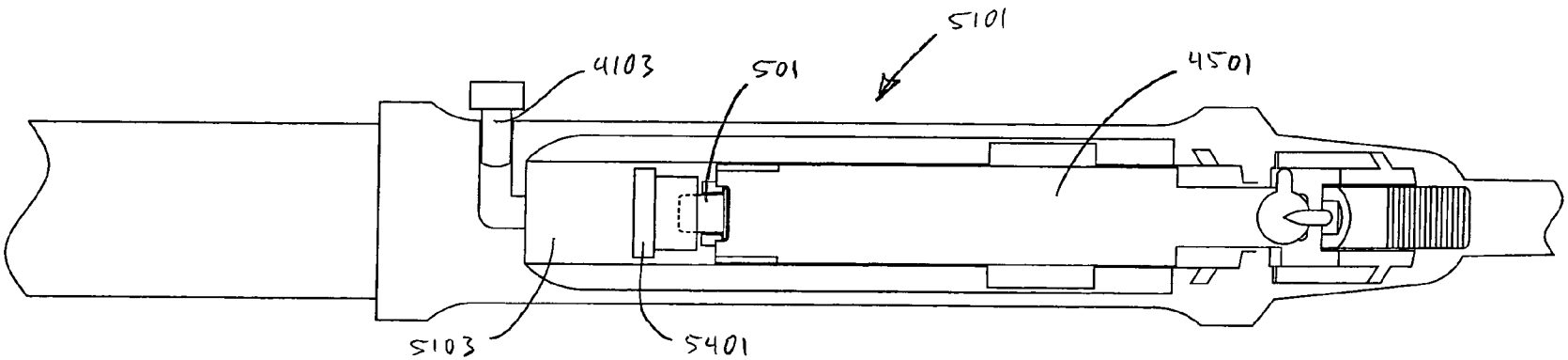
FIG. 54 is a top plan view of the barrel, receiver and action assembly of FIG. 53, subsequent to a primer, attached to a capper made or resilient material, being inserted in the slot of the primer inserter/extractor.

Referring now to FIG. 54, a #209 primer 501 is being loaded into the primer inserter/extractor 4502 using a capper 5401 made of resilient material. The capper 5401 is designed so that it is sufficiently narrow to fit within the receiver recess 5103.

Figure 55:
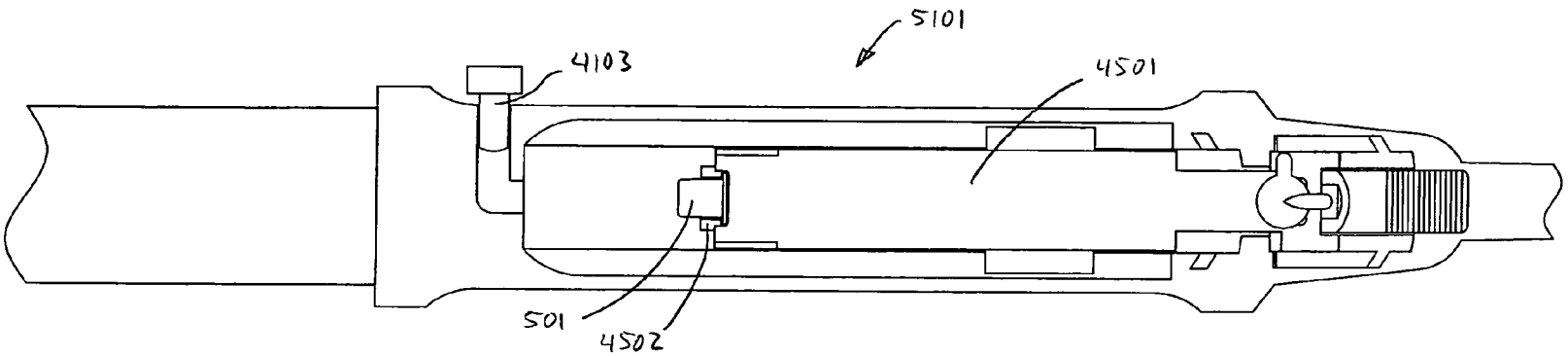
FIG. 55 is a top plan view of the barrel, receiver and action assembly of FIG. 54, subsequent to the capper being pulled from the primer.

Referring now to FIG. 55, the capper 5401 has been pulled away from the primer 501, leaving the latter properly positioned in the inserter/extractor 4502.

Figure 56:
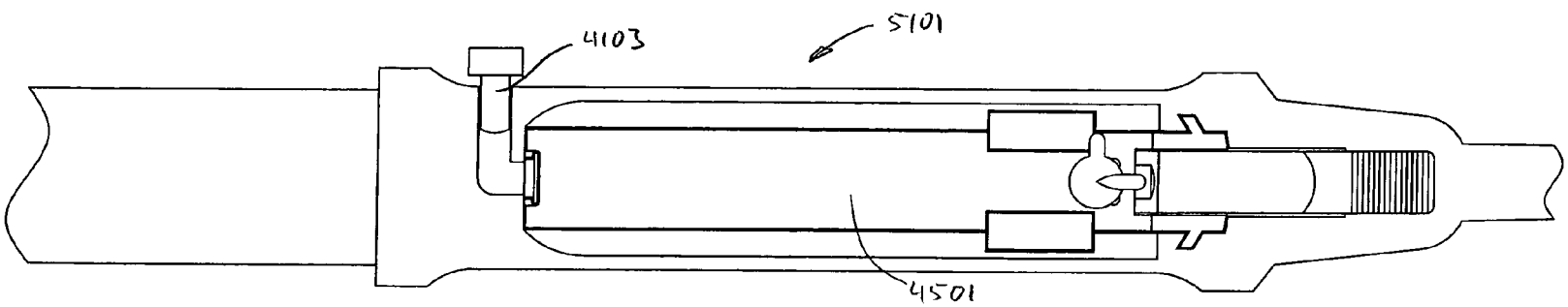
FIG. 56 is a top plan view of the barrel, receiver and action assembly of FIG. 55, subsequent to the action slide being moved forward so that the primer is inserted within the recess of the breech plug.
Figure 57:
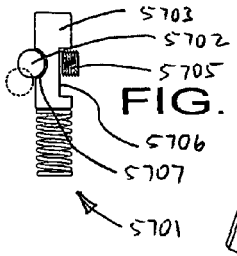
FIG. 57 is a side elevational view of a first embodiment detent mechanism used to lock an easily-removable breech plug within the breech of a muzzleloader rifle.
Figure 58:
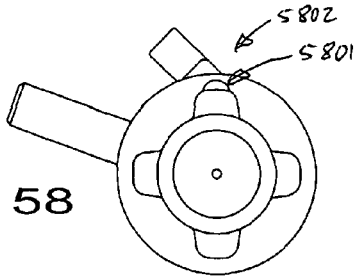
FIG. 58 is a front elevational view of a lugged breech plug which incorporates the first embodiment detent mechanism of FIG. 57.
Figure 59:
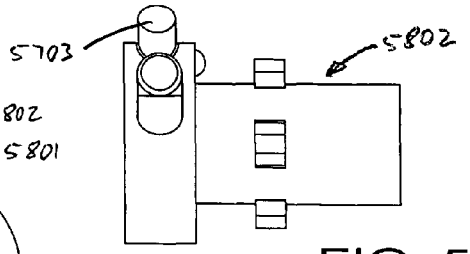
FIG. 59 is a side elevational view of the lugged breech plug of FIG. 58.

Referring now to FIG. 56, the action side 4501 has been moved forward (using the lever beneath the receiver, which is not shown) so that the nipple of the primer 503 is inserted in the primer recess 4105 of the double-lug breech plug 4101.

Referring now to FIGS. 57 through 60, a first embodiment detent mechanism 5701 is used to lock an easily-removable breech plug within the breech of a muzzleloader rifle. The detent mechanism includes a ball bearing 5702, a detent pin 5703 that is upwardly biased by a detent spring 5704, and a set screw 5705 which permits the detent pin 5703 to be moved vertically within the confines of a vertical notch 5706. When the detent pin 5703 is at the upward limit of its travel, the ball bearing 5702 is thrust outwardly by the full diameter of the detent pin 5703 through an aperture 5801 in the breech plug 5802. When depressed by a shooter, the ball bearing 5702 falls into a recess 5707 in the detent pin 5703.

Figure 60:
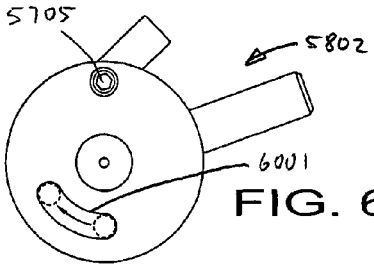
FIG. 60 is a rear elevational view of a the lugged breech of FIG. 58.
Figure 61:
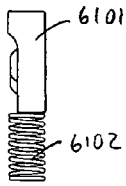
FIG. 61 is a side elevational of a driving detent pin and detent spring of a second embodiment detent mechanism used to lock an easily-removable breech plug within the breech of a muzzleloader rifle.
Figure 62:
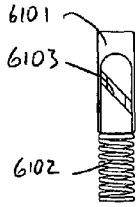
FIG. 62 is a front elevational view of the driving detent pin and detent spring of FIG. 61.
Figure 63:
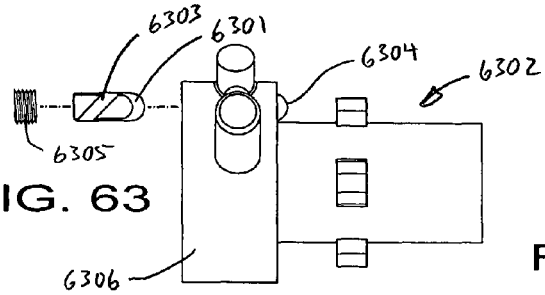
FIG. 63 is an exploded right-side elevational view of a lugged breech plug which incorporates the second embodiment detent mechanism, the driven detent pin and set screw of which are visible.
Figure 64:
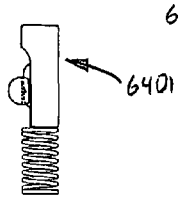
FIG. 64 is a front elevational view of the driving detent pin, detent spring, and driven detent pin of the second embodiment detent mechanism.
Figure 65:
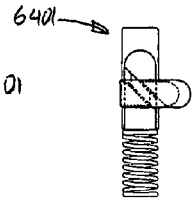
FIG. 65 is a right-side elevational view of the driving detent pin, detent spring, and driven detent pin of the second embodiment detent mechanism.
Figure 66:
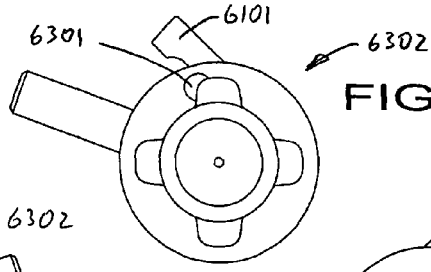
FIG. 66 is a front elevational view of an easily-removable breech plug which incorporates the second embodiment detent mechanism.
Figure 67:
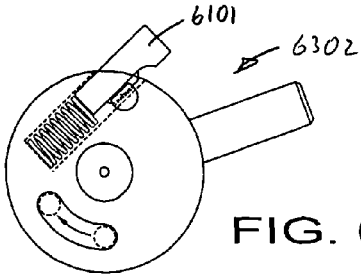
FIG. 67 is a rear elevational, see-through view of the easily-removable breech plug of FIG. 66, which further incorporates a semicircular groove which prevents a rifle from being fired if the breech plug is not rotated to the position where is locked in the breech of the rifle.
Figure 68:
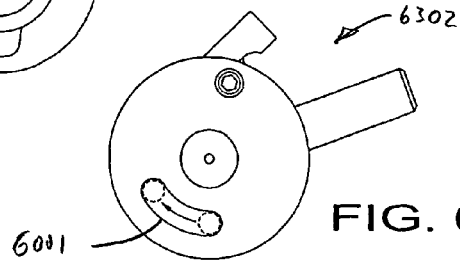
FIG. 68 is a rear elevational view of the fully-assembled breech plug of FIG. 66.

Referring now to FIG. 60 in particular, the rear face of the breech plug 5802 incorporates a semi-circular slot 6001, which acts as a safety lock and prevents the bolt of a bolt action muzzleloader rifle from being fully closed if the breech plug is not in its locked position within the barrel of the rifle.

Referring now to FIGS. 61 through 68, a second embodiment detent mechanism 6401 includes a driving detent pin 6101, a detent spring 6102, and a driven detent pin 6301, which locks the breech plug 6302 within the breech of the rifle barrel. It will be noted that the spring-loaded driving detent pin 6101 has a 45-degree-angle driving tab 6103 that perpendicularly intersects a 45-degree-angle drive groove 6303 on the driven detent pin 6301. Both the driving detent pin 6101 and the driven detent pin 6301 slide within their own cylindrical recesses in the breech plug 6302. The spring loading causes the sliding driven detent pin 6301 to urge its forward end 6304 into a semi-spherical recess (not shown) on the breech end of the rifle barrel. When the driving detent pin 6101 is depressed, the detent pin retracts the driven pin 6101 from the semi-cylindrical recess in the barrel, thereby permitting the breech plug 6302 to be rotated to its unlocked position. A set screw 6305 retains the driven pin 6301 within the rear flange 6306 of the breech plug 6302. Like breech plug of FIGS. 58 through 60, breech plug 6302 also incorporates a semi-circular slot 6001, which acts as a safety lock and prevents the bolt of a bolt action muzzleloader rifle from being fully closed if the breech plug is not in its locked position within the barrel of the rifle.

Figure 69:
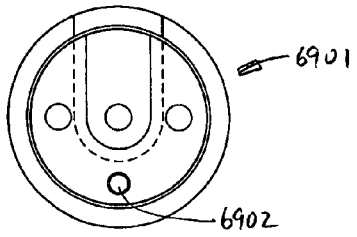
FIG. 69 is a front elevational view of an axially-rotatable action bolt which incorporates a safety pin, the bolt being in an unlatched rotational position.
Figure 70:
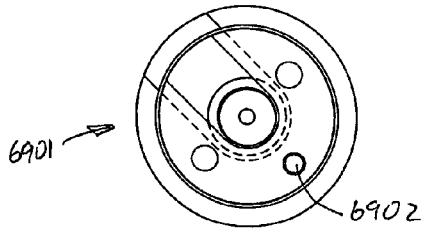
FIG. 70 is a front elevational view of the action bolt of FIG. 69 in a latched rotational position.
Figure 71:
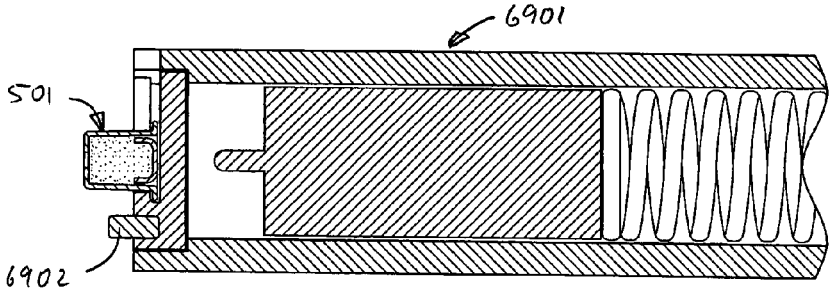
FIG. 71 is a cross-sectional view through the action bolt of FIG. 69.

Referring now to FIGS. 69 through 71, an axially-rotatable action bolt 6901 incorporates a safety pin 6902, which works in combination with either of breech plugs 5801 or 6301 to prevent the bolt of a bolt action muzzleloader rifle from being fully closed if the breech plug is not in its locked position within the barrel of the rifle. FIG. 69 shows the action bolt 6901 in an unlatched rotational position, while FIG. 70 shows the action bolt 6901 in a latched rotational position. If the breech plug 5801 or 6301 is not rotated to its locked position, the action bolt 6901 cannot be fully closed and the gun fired. In the cross-sectional side view of FIG. 71, the safety pin 6902 is clearly visible in profile view.

Figure 72:
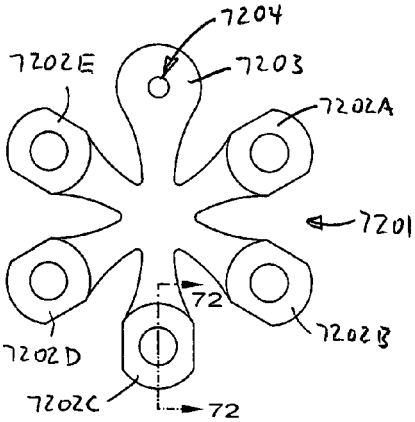
FIG. 72 is a front elevational view of a capper made of resilient polymeric material, which incorporates five primer holders and a top suspending tab having a single perforation for a string.
Figure 73:
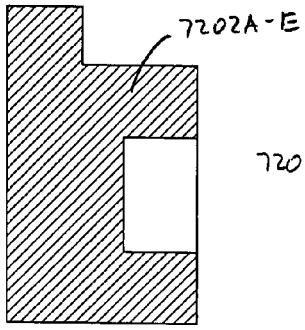
FIG. 73 is a cross-sectional view through section line 73-73 of FIG. 72.
Figure 74:
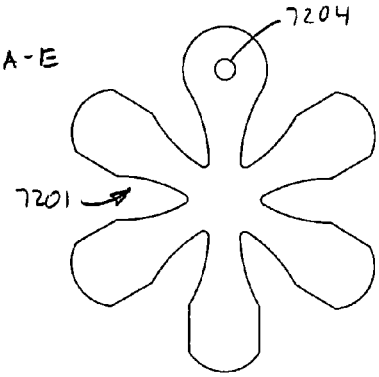
FIG. 74 is a rear elevational view of the capper of FIG. 72.

Referring now to FIGS. 72 through 74, a capper 7201 made of resilient polymeric material incorporates five primer holders 7202A-7202E and a top suspending tab 7203 having a single perforation 7204 for a string (not shown). The string can be used to retain the capper about the neck of a shooter. When primers 501 are held by a primer holder 7202A, 7202B, 7202C, 7202D or 7202E, they are protected from moisture by the resilient material, which may be any durable rubber-like compound. Each of the primer holders 7202A-7202E is sufficiently narrow to be inserted into the recess of any of the common rifle or pistol receivers. In FIG. 54, a primer 501 is shown installed in a primer holder.

Figure 75:
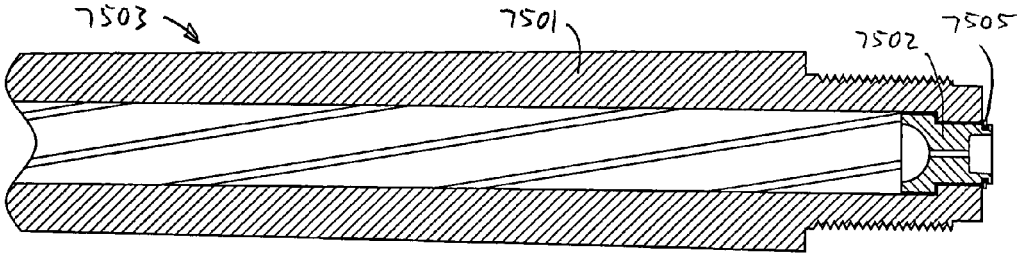
FIG. 75 is a cross-sectional view of a riffle barrel and a first embodiment non-lugged, easily-removable breech plug, taken through a vertical plane passing through the barrel axis.

Referring now to FIG. 75, a cross-sectional view of a riffle barrel 7501 and a first embodiment non-lugged, easily-removable breech plug 7502 is shown. The breech plug 7501 is inserted from the muzzle end 7503 of the barrel 7501. An annular shoulder 7504 unitary with the barrel 7501 and a snap ring 7505 are employed to retain the breech plug 7502 in the breech end of the barrel 7501.

Figure 76:
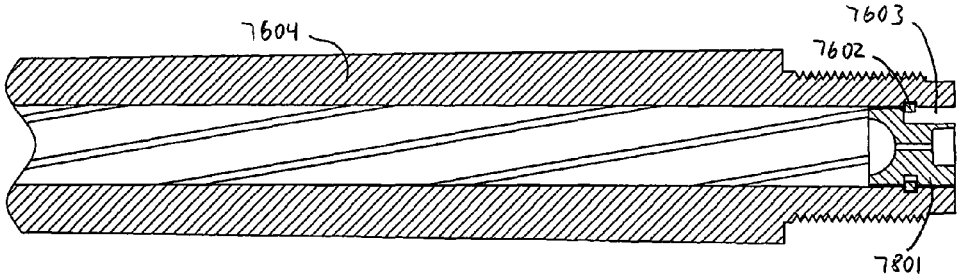
FIG. 76 is a cross-sectional view of a rifle barrel and a second embodiment non-lugged, easily-removable breech plug, taken through a vertical plane passing through the barrel axis.
Figure 77:
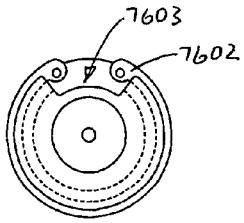
FIG. 77 is a rear elevational view of the breech plug shown in FIG. 76.

Referring now to FIGS. 76 and 77, a second embodiment non-lugged, easily-removable breech plug 7601 is shown. A snap ring 7602, accessible through a recess 7603 at the rear of breech plug 7601, is employed to retain the breech plug 7601 in the barrel 7604.

Figure 78:
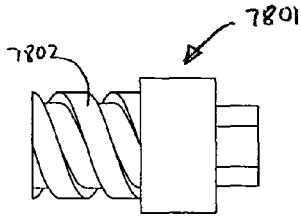
FIG. 78 is a side elevational view of a breech plug having a male, double-helix Acme thread.
Figure 79:
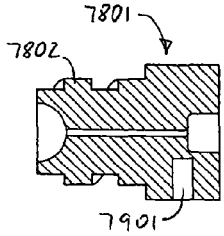
FIG. 79 is a cross-sectional view of the breech plug of FIG. 78, taken through a vertical plane passing through the longitudinal axis thereof.
Figure 80:
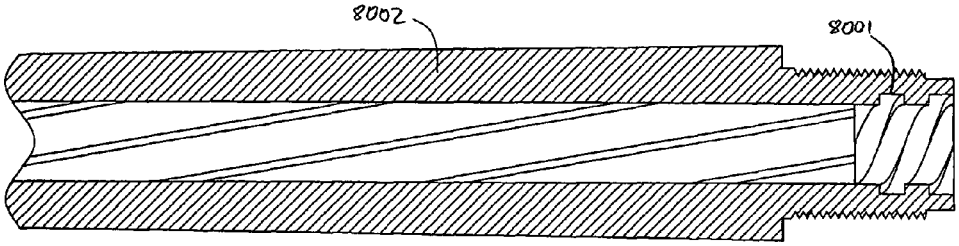
FIG. 80 is a cross-sectional view of a rifle barrel incorporating a female, double-helix Acme thread.

Referring now to FIGS. 78 through 80, a breech plug 7801 having a male, double-helix Acme thread 7802 is shown. The Acme thread 7802 engages a female Acme thread 8001 in a rifle barrel 8002. A retaining pin (not shown), which installs within a cylindrical recess 7901 in the breech plug 7801 and also bears on an upper edge of the rifle's receiver recess, may be employed to retain the breech plug 7801 in its locked position.

Figure 81:
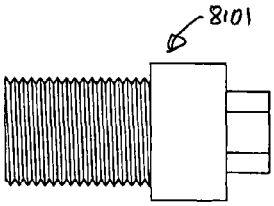
FIG. 81 is a threaded breech plug incorporating a primer recess having a depth compatible for use with a muzzleloader rifle which incorporates a primer inserter/extractor on the action bolt or action slide.
Figure 82:
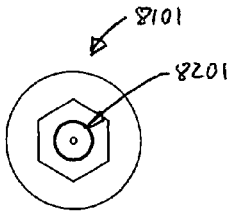
FIG. 82 is a rear elevational view of the threaded breech plug of FIG. 81.
Figure 83:
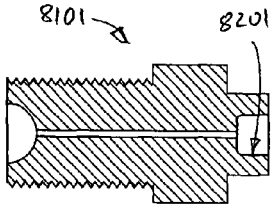
FIG. 83 is a cross-sectional view of the threaded breech plug of FIG. 81, taken through a vertical plan passing through the longitudinal axis thereof.

Referring now to FIGS. 81 through 83, a conventional breech plug 8101 has been modified to incorporate a shortened primer recess 8201 for use with a primer inserter/extractor of the present invention. In other words, it is not necessary to have both an easily removable breech plug and a primer inserter/extractor on the same rifle. Each may be used independently.

It is to be understood that the above-referenced arrangements are illustrative of the application of the principles of the present invention. It will be apparent to those of ordinary skill in the art that numerous modifications can be made without departing from the principles and concepts of the invention as set forth in the claims.

What is claimed is:

1. A muzzleloader firearm system, comprising:

a gun barrel, having a generally cylindrical bore with a breech end, and a plug retaining structure at the breech end;

a breech plug, installable and removable from the breech end, having an interlocking structure configured to interlock with the plug retaining structure via axial rotation of less than about 360 degrees, having a primer recess disposed at a rear thereof, and having an ignition port extending through the breech plug, configured to direct ignition gasses from the primer recess to a combustion region within the breech end;

a movable action member, configured to move between an open position and a closed position adjacent to the primer recess; and primer retention slot, disposed at a forward end of the action member, configured to removably accept a primer, whereby the primer mates with the primer recess when the action member is closed, and is retracted from the primer recess when the action member is opened.

2. A muzzleloader firearm system in accordance with claim 1, wherein the interlocking structure is configured to interlock with the plug retaining structure via axial rotation of less than about 90 degrees.

3. A muzzleloader firearm system in accordance with claim 1, wherein the plug retaining structure includes at least two grooves, and the interlocking structure comprises at least two lugs configured to interlock with the at least two grooves when the breech plug is rotated within the breech end.

4. A muzzleloader firearm system in accordance with claim 1, wherein the primer retention slot is disposed upon a retrofit primer carrier, attachable to a forward end of the moveable action member.

5. A muzzleloader firearm system in accordance with claim 1, further comprising a primer capper, manually holdable by a user, configured to hold a primer in position for insertion of the primer into the primer retention slot.

6. A muzzleloader firearm system in accordance with claim 5, wherein the primer capper is of a resilient polymeric material, and is configured to surround a forward end of a primer cap so as to protect the primer from moisture.

7. A muzzleloader firearm system in accordance with claim 6, wherein the capper is sufficiently narrow to fit within a receiver recess of the muzzleloader firearm.

8. A muzzleloader firearm system in accordance with claim 6, wherein the primer capper includes five primer holders attached to a single device.

9. A muzzleloader firearm system in accordance with claim 1, further comprising a releasable detent, configured to hold the breech plug in a position with the interlocking structure interlocked with the plug retention structure.

10. A muzzleloader firearm system in accordance with claim 1, further comprising interference structure, associated with the breech plug, configured to prevent firing of the firearm when the interlocking structure of the breech plug is not interlocked with the plug retaining structure.

11. A muzzleloader firearm system in accordance with claim 1, wherein the plug retaining structure consists of two grooves oppositely disposed within the breech end, and the interlocking structure of the breech plug consists of two lugs configured to interlock with the two grooves, and further comprising a post, extending from the breech plug, configured to interlock with a slot in a receiver of the firearm when the breech plug is interlocked within the breech end.

12. A muzzleloader firearm system in accordance with claim 1, further comprising an o-ring, associated with a groove of the breech plug, configured to press against a surface of the barrel at the breech end, to resist a flow of explosive gasses past the breech plug.

13. A muzzleloader firearm system in accordance with claim 1, wherein the lug retaining structure comprises female helical threads disposed within the breech end of the barrel, and the interlocking structure of the breech plug comprises male helical threads disposed upon the breech plug.

14. A muzzleloader firearm system, comprising:

a gun barrel, having a generally cylindrical bore with a breech end;

a breech plug, installed in the barrel at the breech end thereof, being installable and removable from the breech end via axial rotation of less than about 360 degrees, having a primer recess, and having an ignition port, extending through the breech plug, configured to direct ignition gasses from the primer recess to a combustion region within the breech end; and a movable action member, having a primer retention slot configured to removably accept a primer, configured to project the primer forward to mate with the primer recess when the action member is closed, and to retract the primer from the primer recess when the action member is opened.

15. A muzzleloader firearm system in accordance with claim 14, wherein the primer retention slot is disposed upon a retrofit primer carrier, attachable to a forward end of the moveable action member.

16. A muzzleloader firearm system in accordance with claim 14, further comprising plug retaining structure at the breech end of the barrel, and wherein the breech plug is installable and removable from the breech end, and includes interlocking structure configured to interlock with the plug retaining structure via axial rotation of less than about 360 degrees.

17. A muzzleloader firearm system in accordance with claim 16, wherein the primer recess is geometrically shaped to accept the primer only when the breech plug is fully interlocked with the plug retaining structure.

18. A muzzleloader firearm system in accordance with claim 14, further comprising an o-ring, associated with a groove of the breech plug, configured to press against a surface of the barrel at the breech end, to resist a flow of explosive gasses past the breech plug.

19. A muzzleloader firearm system in accordance with claim 14, further comprising a primer capper, manually holdable by a user, configured to hold a primer in position for insertion of the primer into the primer retention slot.

20. A muzzleloader firearm system in accordance with claim 19, wherein the primer capper is of a resilient polymeric material, and is configured to surround a forward end of a primer cap, so as to protect the primer from moisture, and is sufficiently narrow to fit within a receiver recess of the muzzleloader firearm.

* * * * *